US006000586A

United States Patent [19]

Cavender

[11] Patent Number: 6,000,586

[45] Date of Patent: Dec. 14, 1999

[54] BOW MAKING APPARATUS

[75] Inventor: Deborah Lea Cavender, Knoxville, Tenn.

[73] Assignee: E-Z Bowz, L.L. C., Sevierville, Tenn.

[21] Appl. No.: 09/090,552

[22] Filed: Jun. 4, 1998

Related U.S. Application Data

[63] Continuation-in-part of application No. 08/824,003, Mar. 25, 1997, which is a continuation-in-part of application No. 08/371,295, Jan. 11, 1995, Pat. No. 5,617,979, which is a continuation-in-part of application No. 08/133,618, Oct. 7, 1993, abandoned.

[51] Int. Cl.[6] ..... A41M 43/00

[52] U.S. Cl. ..... 223/46; 223/44

[58] Field of Search ..... 223/44, 46; 28/147, 28/149, 150; 428/4

[56] References Cited

U.S. PATENT DOCUMENTS

| | | | |
|---|---|---|---|
| 696,361 | 3/1902 | Chase . | |
| 1,010,155 | 11/1911 | Lange . | |
| 1,598,310 | 8/1926 | Quinlan . | |
| 2,077,370 | 4/1937 | Reynolds . | |
| 2,105,436 | 1/1938 | Flatto . | |
| 2,542,222 | 2/1951 | Welch . | |
| 2,569,943 | 10/1951 | Mitchell . | |
| 2,666,249 | 1/1954 | Ruiz et al. . | |
| 2,763,080 | 9/1956 | Welch . | |
| 2,905,368 | 9/1959 | Runyan | 223/46 |
| 3,223,440 | 12/1965 | Rosenzweig . | |
| 3,236,426 | 2/1966 | Kerrigan et al. | 223/46 |
| 3,289,900 | 12/1966 | Mashburn, Jr. et al. | 223/46 |
| 3,377,674 | 4/1968 | Brassaw et al. . | |
| 3,428,227 | 2/1969 | Cavoli . | |
| 3,462,049 | 8/1969 | Smith . | |
| 3,501,070 | 3/1970 | Shattuck . | |
| 3,816,888 | 6/1974 | Rather, Jr. . | |
| 3,854,179 | 12/1974 | Montoya . | |
| 4,337,578 | 7/1982 | Seals . | |
| 4,454,968 | 6/1984 | StLawrence . | |
| 4,629,100 | 12/1986 | Owens . | |
| 4,714,182 | 12/1987 | Hecht . | |
| 5,100,706 | 3/1992 | Zaweski . | |
| 5,215,791 | 6/1993 | Davignon . | |
| 5,411,188 | 5/1995 | Teuten . | |

*Primary Examiner*—Bibhu Mohanty
*Attorney, Agent, or Firm*—Luedeka, Neely & Graham, P.C.

[57] ABSTRACT

A bow making apparatus (10) for receiving and maintaining the disposition of bow fabricating material during the making of a decorative bow. The bow making apparatus (10) includes a base member (12) defining an upper work surface (14) for supporting bow fabricating material (28) during the bow making operation. The apparatus (10) also includes first, second and third retainer members (22, 24,25) extending upwardly from the upper work surface (14) of the base member (12) for releasably receiving and maintaining the position of gathered sections of bow fabricating material (28). The apparatus (10) also includes a ribbon spool holder (50) for supporting a ribbon spool while fabricating a bow.

16 Claims, 2 Drawing Sheets

BOW MAKING APPARATUS

This application in part discloses and claims subject matter disclosed in my earlier filed pending application, Ser. No. 08/824,003, filed Mar. 25, 1997, which in part disclosed and claimed subject matter disclosed in my earlier filed application Ser. No. 08/371,295, filed on Jan. 11, 1995, which is now U.S. Pat. No. 5,617,979, which in part disclosed and claimed subject matter disclosed in my earlier filed application Ser. No. 08/133,618 filed on Oct. 7, 1993, which is now abandoned.

TECHNICAL FIELD

This invention relates a bow making apparatus for receiving and maintaining the disposition of bow fabricating material during the making of a decorative bow. In this particular invention the apparatus includes a plurality of selectively spaced retainer members disposed on the upper work surface of a base member and a base extension extending from the base member which includes a spool support.

BACKGROUND ART

Decorative bow making has long been recognized as an art, and substantial skill is generally required to manually tie well proportioned decorative bows. Of course, automation of the bow making industry has given rise to complex machinery for producing decorative bows, but such machinery is expensive and takes originality, creativity and, indeed, enjoyment, out of the bow making process. Attempts have been made to devise bow making devices that are inexpensive, but they too tend to limit the bow maker's creativity by dictating the resulting bow configuration. Examples of such devices ate disclosed in the following U.S. Patents:

| U.S. Pat. No. | Inventor(s) | Issue Date |
|---|---|---|
| 696,361 | E. S. Chase | Mar 25, 1902 |
| 1,010,155 | W. E. Lange | Nov 28, 1911 |
| 1,598,310 | T. A. Quinlan | Aug 31, 1926 |
| 2,077,370 | R. K. Reynolds | Apr 13, 1937 |
| 2,105,436 | G. Flatto | Jan 11, 1938 |
| 2,542,222 | A. F. Welch | Feb 20, 1951 |
| 2,569,943 | J. W. Mitchell | Oct. 2, 1951 |
| 2,666,249 | R. R. Ruiz, et al. | Jan 19, 1954 |
| 2,763,080 | A. F. Welch | Sep 18, 1956 |
| 3,223,440 | W. Rosenzweig | Dec 14, 1965 |
| 3,428,227 | J. W. Cavoli | Feb 18, 1969 |
| 3,462,049 | R. P. Smith | Aug 19, 1969 |
| 3,501,070 | W. M. Shattuck | Mar 17, 1970 |
| 3,816,888 | J. B. Rather, Jr. | Jun 18, 1974 |
| 4,454,968 | J. J. St Lawrence | Jun 19, 1984 |
| 4,629,100 | B. Owens | Dec 16, 1986 |
| 4,714,182 | D. Hecht | Dec 22, 1987 |

Other devices have been produced for measuring filaments for subsequent use, such as in tassels and pompons. Typical of the art are those devices disclosed in the following U.S. Patents:

| U.S. Pat. No. | Inventor(s) | Issue Date |
|---|---|---|
| 3,377,674 | R. F. Brassaw, et al. | Apr 16, 1968 |
| 3,854,179 | J. Montoya | Dec 17, 1974 |
| 4,337,578 | E. L. Seals | Jul 6, 1982 |

Typical bows are disclosed in the following U.S. Patents:

| U.S. Pat. No. | Inventor(s) | Issue Date |
|---|---|---|
| 5,100,706 | L. Zaweski | Mar 31, 1992 |
| 5,215,791 | E. A. Davignon | Jun 1, 1993 |

Of all of the prior art references cited, none teaches a device for fabricating a decorative bow wherein the device serves to retain the gathered portion of the bow such that the loops of the bow may be independently measured and freely maintained. Further, none of the prior art devices provides a means for independently retaining a plurality of bows. Further, none teaches an extension for supporting a spool of ribbon.

Therefore, it is an object of the present invention to provide a bow making apparatus for receiving and maintaining the disposition of bow fabricating material during the making of a decorative bow.

It is another object of the present invention to provide a bow making apparatus which assists in the tying of a decorative bow, but does not stifle originality or creativity in the bow making operation.

Further, it is an object of the present invention to provide a bow making apparatus which includes a ribbon spool holder for supporting a ribbon spool during the bow making process.

Yet another object of the present invention is to provide a bow making apparatus which is simple to use and inexpensive.

DISCLOSURE OF THE INVENTION

Other objects and advantages will be accomplished by the present invention which provides a bow making apparatus for receiving and maintaining the disposition of bow fabricating material during the making of a decorative bow. The bow making apparatus includes a base member defining an upper work surface for supporting bow fabricating material during the bow making operation. The apparatus also includes at least first and second retainer members extending upwardly from the upper work surface of the base member, between which gathered sections of bow fabricating material are received and maintained. In one embodiment the first and second retainer members are selectively spaced so as to define a retaining gap therebetween for releasably receiving and maintaining the position of gathered sections of the bow fabricating material. In a further embodiment, a third retainer member extends upwardly from the upper work surface of the base member, the second and third retainer member serving in like fashion as the first and second retainer members. In this embodiment, the third retainer member is spaced closer to the second retainer member than is the first retainer member, and the third retainer member defines a height shorter than that of the first and second retainer members. Thus, the first and second retainer members aid in the fabrication of a larger bow using wider ribbon, while the second and third retainer members more appropriately aid in the fabrication of smaller bows using narrower ribbon. In a preferred embodiment of the apparatus the upper work surface of the base member is provided with measuring indicia to facilitate the making of bows having preselected dimensions. Further, in the preferred embodiment, the bow making apparatus includes a ribbon spool holder for supporting a ribbon spool while fabricating a bow.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
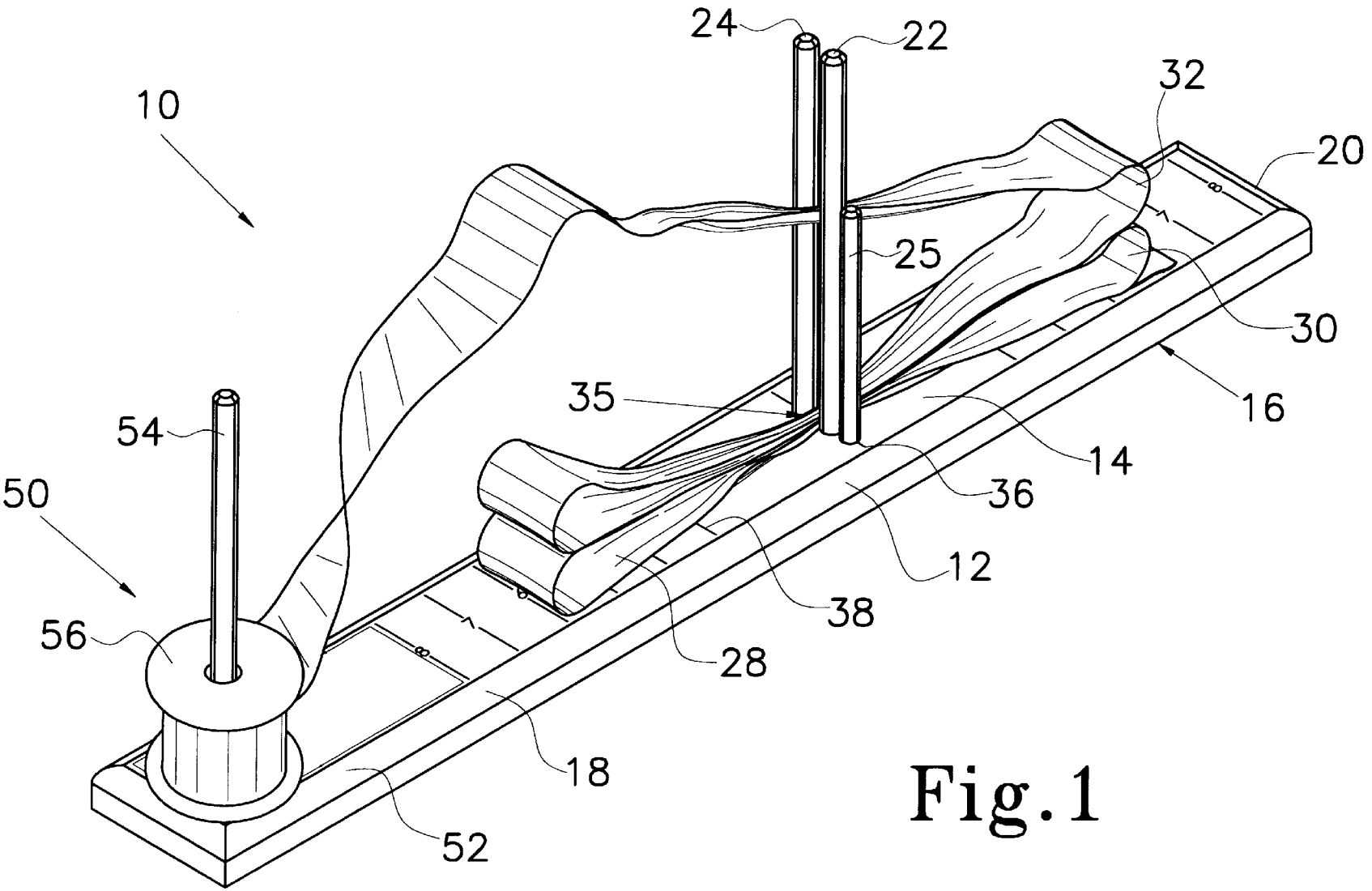
FIG. 1 illustrates a perspective view of the bow making apparatus of the present invention.

A bow making apparatus incorporating various features of the present invention is illustrated generally at 10 in the Figures. As will be discussed below, the apparatus 10 provides a work surface for fabricating a decorative bow and a means for retaining the ribbon or other material being used to fabricate the bow during the fabricating process.

The apparatus 10 includes a base member 112 having a substantially planar upper work surface 14, and a lower surface 16 for supporting the apparatus 10 on a table or other support surface. In the preferred illustrated embodiment the base member 12 defines an elongated rectangular configuration. However, it will be recognized that the base member 12 can assume any other geometric configuration.

Figure 2A:
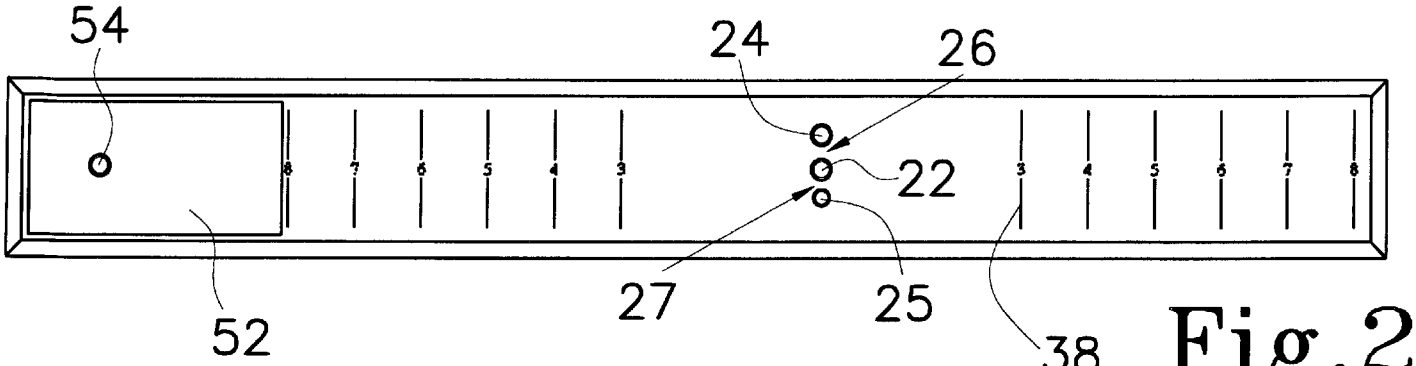
FIG. 2*a* illustrates a top view of the bow making apparatus of the present invention; and, FIG. 2*b* illustrates a side elevation view of the bow making apparatus of the present invention.
Figure 2B:
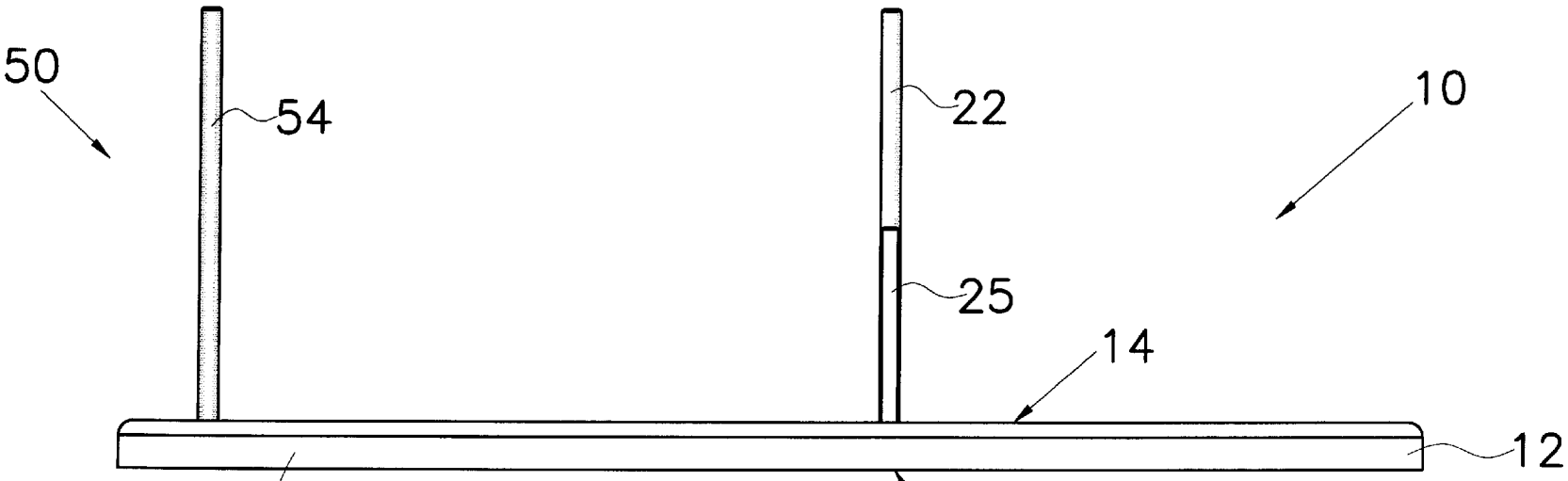

The base member 12 has first and second opposite ends 18 and 20, respectively. Mounted between the opposite ends 18 and 20 are at least two retainer members 22 and 24. As shown in FIGS. 1 and 2*a,* first, second and third retainer members 22, 24 and 25 are provided. In the preferred embodiment the retainer members 22, 24 and 25 define elongated rods having substantially circular cross-sections, and extend upwardly from the upper work surface 14. The retainer members 22 and 24 each define a length substantially equal one to the other, while in the preferred embodiment, the retainer member 25 defines a length shorter than that of the retainer members 22 and 24. As will be discussed below, the retainer member 25 is provided to cooperate with the retainer member 22 to assist in the fabrication of bows smaller than those fabricated using the retainer members 22 and 24.

As illustrated in FIGS. 1 and 2*a,* the retainer members 22 and 24 are selectively spaced so as to define a retaining gap 26 therebetween for releasably receiving the ribbon or other bow fabricating material being used. Though not shown, it is envisioned that no retaining gap may be defined therebetween such that a bow which is being fabricated of thin ribbon or other thin bow fabricating material is more securely held. In either case, the retainer members 22 and 24 are positioned relative to each other such that the bow fabricating material 28 is pinched therebetween such that individual loops are not unselectively released therefrom.

The retainer members 22 and 25 are selectively spaced so as to define a retaining gap 27. The retaining gap 27, in the preferred embodiment, is substantially proportionate to the retaining gap 26 according to the relative proportions of the retaining member 22 and the retaining member 25. In the illustrated embodiment, the retaining gap 27 is approximately one-half the width of the retaining gap 26. The shorter height of the retaining member 25 and the narrower retaining gap 27 combine to provide a more appropriate device for fabricating decorative bows from a narrower bow fabricating material 28 than that used to fabricate decorative bows using the retaining members 22 and 24. Specifically, the shorter retaining member 25 allows shorter loops to be fabricated, while the narrower retaining gap 27 more closely gathers a narrower material 28. As before, the retaining gap 27 is dimensioned such that the bow fabricating material 28 is pinched therein such that any loops formed therein are held unattended.

As illustrated in FIG. 1, the retainer members 22 and 24, or the retainer members 22 and 25, engage and pinch the bow fabricating material 28 at the point at which the material is gathered 35, i.e. the point at which bow is to be bound together with a wire or other securing means. More specifically, in relation to the present invention, the gathered portions 35 of the material 28 are defined as the midpoints of the material 28 between successive loops which are contacted and retained, or pinched, by the retainer members 22 and 24, or 22 and 25. Therefore, the spacing of the retainer members 22 and 24 is such that the gathered bow fabricating material 28 is securely, yet releasably held between the retainer members 22 and 24 as the bow making operation proceeds. Likewise, the spacing of the retainer members 22 and 25 is such that the gathered bow fabricating material 28 is securely, yet releasably held between the retainer members 22 and 25 as the bow making operation proceeds.

As shown in the Figures, the preferred embodiment of the bow making apparatus includes a ribbon spool holder 50. The ribbon spool holder 50 includes a base extension 52 extending from the first end 18 of the base member 12 and a support member 54 mounted to the base extension 52. Specifically, the support member 54 is an elongated rod having a substantially circular cross-section and extends upwardly from the base extension 52. The ribbon spool holder 50 is configured to receive and support at least one ribbon spool 56 and facilitates the production of bows. It will be noted that, depending upon the width of the spool, more than one spool can be supported on the support member 54.

FIG. 1 illustrates one possible bow making operation which can be performed utilizing the apparatus 10 and illustrates the function of the retainer members 22 and 24 and the retaining gap 26 and the ribbon spool holder 50. In accordance with the illustrated example, a ribbon spool 56, upon which the fabricating material 28 is wound, is placed on the support member 54 of the ribbon holder 50. A first end 30 of a length of fabricating material 28 is placed on the work surface 14 between the retainer members 22, 24 and, for example, the second end 20 of the base member 12. At a preselected point along its length the fabricating material is gathered and inserted between the retainer members 22 and 24 as illustrated in FIG. 1 such that gathered portion 35 of the material 28 is maintained by the retainer members 22 and 24. Between the retainer members 22, 24 and the first end 18, and at a preselected point along the length of fabricating material 28, a first loop 32 is formed and the length of fabricating material is again gathered and passed between the retainer members 22 and 24 at a preselected point along its length such that the retainer members 22 and 24 maintain the gathered portion 35 of the fabricating material 28 and, as a result, maintain the disposition of the first loop 32. A second loop 34 is then formed between the retainer members 22, 24 and the second end 20 and the fabricating material 28 is again gathered and passed between the retainer members 22 and 24. This process is repeated until the desired number of loops is formed on either side of the retainer members 22 and 24, with the retainer members 22 and 24 serving to maintain the gathered portions 35 of the fabricating material 28. The gathered portions 35 of the fabricating material 28 can then be removed from between the retainer members 22 and 24 for binding or the gathered portions 35 can be bound in place. A similar method is used for fabricating a decorative bow using the retainer members 22 and 25.

As best illustrated in FIG. 1, in the preferred embodiment of the apparatus 10 the upper work surface 14 is provided with measurement indicia which facilitates the fabrication of uniformly proportioned bows of a preselected size. For example, in the illustrated embodiment a center line 36 is provided which is aligned with the lower end of the gap 26. Further, between the center line 36 and the first and second ends 18 and 20 the work surface 14 is ruled with loop measuring lines 38 which indicate selected distances from the center line 36. For example, in the illustrated embodiment the loop measuring lines 38 on either side of the center line 36 are positioned at 1", 2", 3", 4", 5", 6", 7" and 8" from the center line 38, and numeric indicia are provided to facilitate the use of the ruled surface.

It will be appreciated that the indicia provided on the work surface 14 facilitates the making of bows with uniform proportions and/or bows having loops of selected lengths. It will also be appreciated that the units of measure depicted on the work surface can be metric or based upon some other measurement system.

While fabricating decorative bows, the length of successive loops is selected in accordance with the desired overall look of the finished bow. For example, as illustrated in FIG. 1, the first and second loops 30 and 32 define substantially equal lengths. It is envisioned that several other successive loops may form equal lengths to those. However, it is also envisioned that further successive loops may define proportionately shorter lengths such that the finished decorative bow is fuller, with the shorter loops filling the middle portion of the bow. The variations in the lengths of the loops in infinite.

In light of the above it will be recognized that the present invention provides a bow making apparatus having great advantages over the prior art. The apparatus 10 obviates the need for the bow maker to grasp and maintain the successive gathered portions of the bow during the formation of a plurality of loops. Further, it facilitates the making of bows with uniform proportions and having loops of preselected sizes. The apparatus also facilitates the making of decorative bows of varying sizes, using fabricating materials of varying weights and widths. The apparatus also includes a ribbon spool holder for supporting ribbon spools. However, while a preferred embodiment has been shown and described, it will be understood that there is no intent to limit the invention to such disclosure, but rather it is intended to cover all modifications and alternate constructions falling within the spirit and scope of the invention as defined in the appended claims.

Having thus described the aforementioned invention, I claim:

1. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus comprising:

a base member defining an upper work surface, a first end and a second end, said work surface being adapted to support thereupon at least the looped portions of the bow fabricating material during the making of a decorative bow;

at least a first and second retainer member being adapted to pinch therebetween the gathered sections of bow fabricating material, each said at least a first and second retainer member being affixed to and extending upwardly from said upper work surface of said base member from a proximal end of said at least a first and second retainer member to a distal end of said at least a first and second retainer member, the gathered sections of bow fabricating material being releasably maintained in a gathered disposition; and, a ribbon spool holder extending from said base member.

2. The apparatus of claim 1 wherein said at least a first and second retainer member consists of a first retainer member, a second retainer member, and a third retainer member, each of said first, second and third retainer members defining elongated rods having a substantially circular cross-section.

3. The apparatus of claim 2 wherein said first and second retainer members define substantially equal lengths, and wherein said third retainer member defines a length of approximately one-half said length of said first and second retainer members.

4. The apparatus of claim 2 wherein said upper work surface of said base member is provided with indicia for facilitating the making of bows having looped portions of preselected length.

5. The apparatus of claim 4 wherein said first and second retainer members are selectively spaced so as to define a first retaining gap therebetween for releasably receiving the gathered sections of bow fabricating material, wherein said second and third retainer members are selectively spaced so as to define a second retaining gap therebetween for releasably receiving the gathered sections of bow fabricating material, and wherein said indicia includes a center line disposed on said upper work surface proximate said proximal end of said first, second and third retainer members.

6. The apparatus of claim 5 wherein said indicia includes a plurality of loop measuring lines disposed between said center line and said first end of said base member at preselected distances from said center line, and a plurality of loop measuring lines disposed between said center line and said second end of said base member at preselected distances from said center line.

7. The apparatus of claim 1 wherein said ribbon spool holder includes a base extension and a support member, said base extension extending from said first end of said base member, said support member extending upwardly from said base extension and configured to be received within an opening of a ribbon spool.

8. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus comprising:

a base member defining an upper work surface, a first end and a second end, said upper work surface for supporting the bow fabricating material during the making of a decorative bow, said upper work surface being provided with indicia for facilitating the making of bows having looped portions of preselected length, a first and second retainer member being adapted to pinch therebetween the gathered sections of bow fabricating material, said first and second retainer members extending upwardly from said upper work surface of said base member from a proximal end of said first and second retainer members to a distal end thereof, the gathered sections of bow fabricating material being releasably maintained in a gathered disposition, said first and second retainer members being selectively spaced so as to define a retaining gap therebetween for pinching the gathered sections of bow fabricating material, said upper work surface indicia including a center line disposed on said upper work surface proximate said proximal end of said first and second retainer members, and, a ribbon spool holder extending from said base member.

9. The apparatus of claim 8 wherein said indicia includes a plurality of loop measuring lines disposed between said center line and a first end of said base member at preselected distances from said center line, and a plurality of loop measuring lines disposed between said center line and a second end of said base member at preselected distances from said center line.

10. The apparatus of claim 8 wherein said ribbon spool holder includes a base extension and a support member, said base extension extending from said first end of said base member, said support member extending upwardly from said base extension and configured to be received within an opening of a ribbon spool.

11. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus comprising:

a base member defining an upper work surface, a first end and a second end, said work surface being adapted to support thereupon at least the looped portions of the bow fabricating material during the making of a decorative bow;

at least a first and second retainer member being adapted to pinch therebetween the gathered sections of bow fabricating material, each said at least a first and second retainer member being affixed to and extending upwardly from said upper work surface of said base member from a proximal end of said at least a first and second retainer member to a distal end of said at least a first and second retainer member, the gathered sections of bow fabricating material being releasably maintained in a gathered disposition; and, a ribbon spool holder including a base extension and a support member, said base extension extending from said first end of said base member, said support member extending upwardly from said base extension and configured to be received within an opening of a ribbon spool.

12. The apparatus of claim 11 wherein said at least a first and second retainer member consists of a first retainer member, a second retainer member, and a third retainer member, each of said first, second and third retainer members defining elongated rods having a substantially circular cross-section.

13. The apparatus of claim 12 wherein said first and second retainer members define substantially equal lengths, and wherein said third retainer member defines a length of approximately one-half said length of said first and second retainer members.

14. The apparatus of claim 12 wherein said upper work surface of said base member is provided with indicia for facilitating the making of bows having looped portions of preselected length.

15. The apparatus of claim 14 wherein said first and second retainer members are selectively spaced so as to define a first retaining gap therebetween for releasably receiving the gathered sections of bow fabricating material, wherein said second and third retainer members are selectively spaced so as to define a second retaining gap therebetween for releasably receiving the gathered sections of bow fabricating material, and wherein said indicia includes a center line disposed on said upper work surface proximate said proximal end of said first, second and third retainer members.

16. The apparatus of claim 15 wherein said indicia includes a plurality of loop measuring lines disposed between said center line and said first end of said base member at preselected distances from said center line, and a plurality of loop measuring lines disposed between said center line and said second end of said base member at preselected distances from said center line.

* * * * *